US006085478A

United States Patent [19]

Workman

[11] Patent Number: 6,085,478

[45] Date of Patent: Jul. 11, 2000

[54] IMPALEMENT PREVENTION SAFETY SYSTEM

[75] Inventor: Gary Workman, Lombard, Ill.

[73] Assignee: Deslauriers, Inc., Braodview, Ill.

[21] Appl. No.: 09/131,991

[22] Filed: Aug. 11, 1998

[51] Int. Cl.[7] ..... E04H 12/00; E04C 5/16

[52] U.S. Cl. ..... 52/301; 52/289.1; 52/300; 52/689; 74/553; 248/188.9; 248/523; 138/96 R

[58] Field of Search ..... 52/301, 300, 289.1, 52/687–689, 677, 298, 679, 682, 685, 669; 74/552, 553, 554, 551.1, 551.9; 138/96 R, 96 T, 10 J; 248/188.7, 188.9, 523; 16/118, 121, DIG. 30

[56] References Cited

U.S. PATENT DOCUMENTS

| | | | |
|---|---|---|---|
| 5,313,757 | 5/1994 | Schnepf . | |
| 5,363,618 | 11/1994 | Underwood . | |
| 5,568,708 | 10/1996 | Kassardjian et al. . | |
| 5,600,927 | 2/1997 | Kennon | 52/301 |
| 5,613,336 | 3/1997 | Workman . | |
| 5,729,941 | 3/1998 | Kassardjian et al. | 52/301 |
| 5,884,443 | 3/1999 | Schimmelpfennig et al. | 52/301 |
| 5,943,836 | 8/1999 | Kassardjian | 52/301 |

FOREIGN PATENT DOCUMENTS

WO9114839 10/1991 WIPO .

*Primary Examiner*—Carl D. Friedman
*Assistant Examiner*—Yvonne M. Horton
*Attorney, Agent, or Firm*—Wood, Phillips, VanSanten, Clark & Mortimer

[57] ABSTRACT

A safety system is provided for use with a concrete reinforcing bar or rebar. The system includes a cover having a cover base plate with a first, force-receiving surface and a second surface and a collar having a collar wall attached to the second surface of the cover base plate and having an inner surface defining a bore. A mechanism is attached to the collar wall for maintaining the system in an operative position relative to an end of a rebar. A plate is disposed in the bore spaced from the second surface of the cover to define an interior space and having an engagement surface abuttable against the rebar end. One of the plate and the collar is deformable to resist movement of the rebar end through the interior space and the cover.

22 Claims, 12 Drawing Sheets

IMPALEMENT PREVENTION SAFETY SYSTEM

FIELD OF THE INVENTION

The present invention is directed to a safety system for preventing impalement, and in particular a safety system for preventing impalement through dissipation of energy and containment of forces.

BACKGROUND OF THE INVENTION

Construction workers face many hazards at the worksite. One of the hazards workers face is the risk of impalement on exposed concrete reinforcement bars, or rebars. Rebars are steel shafts imbedded in concrete to increase the strength of the concrete composite in tension, as concrete is weaker in tension than in compression. It is not uncommon during the construction of a concrete structure, for example a foundation, for a first end of a rebar to be imbedded in the concrete while a second end projects from the poured concrete. Contact with the exposed end of the rebar can result in serious injury, including impalement.

To prevent impalement, it is known in the art to attach a plastic cap to an exposed end of a rebar. This is a generally acceptable solution where, as in the case of contact with a horizontally projecting rebar, the forces applied to the cap are limited. The plastic cap is typically less successful in preventing serious injury where significant forces are applied to the cap, such as when, for example, a construction worker falls onto a cap attached to a vertically projecting rebar.

It is therefore also known in the art to attach a steel plate or bar to a cap disposed over an exposed end of a rebar to reduce the impalement risk. Occasionally, the steel plate is permanently imbedded in the cap. See U.S. Pat. Nos. 5,568,708 and 5,313,757. Other times, the bar or plate is releasably secured to the cap. See U.S. Pat. No. 5,363,618. Still other times, the plate is secured between a cover and the cap. See U.S. Pat. No. 5,613,336.

The present invention is directed to further improvements in safety systems.

SUMMARY OF THE INVENTION

According to an aspect of the present invention, a safety system is provided for use with a concrete reinforcing bar or rebar. The system includes a cover having a cover base plate with a first, force-receiving surface and a second surface, and a collar having a collar wall attached to the second surface of the cover base plate and having an inner surface defining a bore. A mechanism is attached to the collar wall for maintaining the system in an operative position relative to an end of a rebar. A plate is disposed in the bore spaced from the second surface of the cover base plate to define an interior space, and having an engagement surface abuttable against the rebar end. One of the plate and the collar is deformable to resist movement of the rebar end through the interior space and the cover.

Moreover, the plate may have a plate edge which abuts the inner surface of the collar wall, the plate and the collar wall being moveable relative to each other such that the plate edge deforms the collar wall as the plate and the collar wall move relative to each other to dissipate the energy generated by a force applied to the cover with a rebar end abutting the engagement surface of the plate.

Additionally, the plate may have a base with a base surface abuttable against an end of a rebar. The plate may also have a plate wall with a plate wall surface, the plate wall attached to the base with the plate wall surface generally transverse to the base surface to resist movement of the rebar end relative to the base with the rebar end abutting the base surface.

Further, the system may include a spacer disposed in the interior space on the plate, and a second plate disposed in the interior space on the spacer.

According to another aspect of the invention, a safety system is provided for use with a concrete reinforcing bar or rebar including a cover for receiving a force thereon, a support assembly attached to the cover and attachable to a rebar to hold the system in an operative position relative to an end of a rebar, and a mechanism disposed between the cover and the support assembly for dissipating the energy generated by a force applied to the cover to resist penetration of the cover with the support assembly attached to a rebar.

The cover may include a cover base plate with a first surface for receiving a force thereon and a second surface, and the support assembly may include a cap with a surface spaced from the second surface of the cover to define a space therebetween. The mechanism for dissipating the energy generated by a force applied to the cover may include a first dissipator plate disposed in the space on the cap surface, a first spacer disposed in the space on the first dissipator plate, and a second dissipator plate disposed in the space on the first spacer. Additionally, a second spacer may be disposed in the space on the second dissipator plate, and a third dissipator plate may be disposed in the space on the second spacer. Further, the cover base plate may be a plastic plate and the first and second dissipator plates may be steel plates.

Alternatively, the mechanism for dissipating the energy generated by a force applied to the cover may include a collar attached to the cover and having a wall with an inner surface which defines a frusto-conical bore with an apex at a first end and a base at a second end, and a plate abuttable against an end of a rebar with the system in the operative position relative to the rebar and disposed at the base of the frusto-conical bore with an edge of the plate abutting the inner surface of the collar wall. The plate is moveable within the frusto-conical bore so as to cooperate with the collar wall such that one of the plate and the collar wall deforms as the plate and the collar wall move relative to each other to dissipate the energy generated when a force is applied to the cover and the support assembly is attached to a rebar. The collar wall may be a plastic wall, and the plate may be a steel plate.

According to yet another aspect of the present invention, a safety system is provided for use with a concrete reinforcing bar or rebar. The system includes a cover for receiving a force thereon, and a support assembly attached to the cover and attachable to a rebar to hold the system in an operative position relative to an end of a rebar. A barrier assembly is disposed between the cover and the support assembly having a barrier base plate with an engagement surface abuttable against an end of a rebar with the system in the operative position relative to a rebar end to resist penetration of the cover by the rebar and a barrier wall attached to the barrier base plate having a surface generally transverse to the engagement surface abuttable against an end of a rebar with the system in the operative position to restrict the movement of a rebar end relative to the barrier base plate.

The surface of the first barrier wall may define a receptacle for receiving an end of a rebar therein. The support assembly may include a support assembly collar having a support assembly collar wall with an inner surface which defines a bore to receive an end of a rebar therein, the bore being in communication with the receptacle so that a rebar end may be disposed through the bore and received in the receptacle. The barrier wall of the barrier assembly may depend into the bore of the support assembly collar. Fins may be attached to the collar wall and abuttable against a rebar to maintain the system in the operative position on the rebar.

The cover may include a cover base plate having a first surface for receiving a force thereon and a plurality of ribs overlaid on the first surface of the cover base plate to reinforce the cover base plate. The plurality of ribs may include a first rib overlaid on the first surface of the cover base plate along a first axis and a second rib overlaid on the first surface of the cover first plate along a second axis transverse to the first axis. The first and second axes may be orthogonal to each other.

The cover may include a cover base plate with a surface, and a first collar may be attached to the surface of the cover base plate. The first collar may have a wall with an inner surface which with the surface of the cover base plate defines a first interior space with an open end. The barrier assembly is disposed within the first interior space, and a first end of the support assembly is disposed in the open end and attached to the first collar.

The first collar may also have a shoulder and the barrier base plate may have an edge which abuts the shoulder and cooperates with the shoulder to dissipate energy generated when a force is applied to the cover and the support assembly is attached to a rebar.

The first collar may further have a rim at the open end of the first interior space, and the support assembly may include a cap having an edge, the rim deformed to abut the edge with the first end of the support assembly disposed in the first interior space to attach the support assembly to the cover.

A second collar may be attached to the surface of the cover base plate, the second collar having a wall with an inner surface which with the surface of the cover base plate defines a second interior space in which barrier base plate and barrier wall are received with the barrier assembly disposed in the first interior space.

Additionally, the cover may include a cover base plate with a surface, and the safety system may further include a first collar attached to the surface of the cover base plate and having a wall with an inner surface that defines with the surface of the cover base plate an interior space with an open end. The collar may have a stop disposed within the interior space and the support assembly a with a seat defined therein in which the stop is disposed with the cap disposed in the interior space e so that the support assembly is rotatably fixed relative to the cover.

DETAILED DESCRIPTION OF THE PREFERRED EMBODIMENTS

Figure 1:
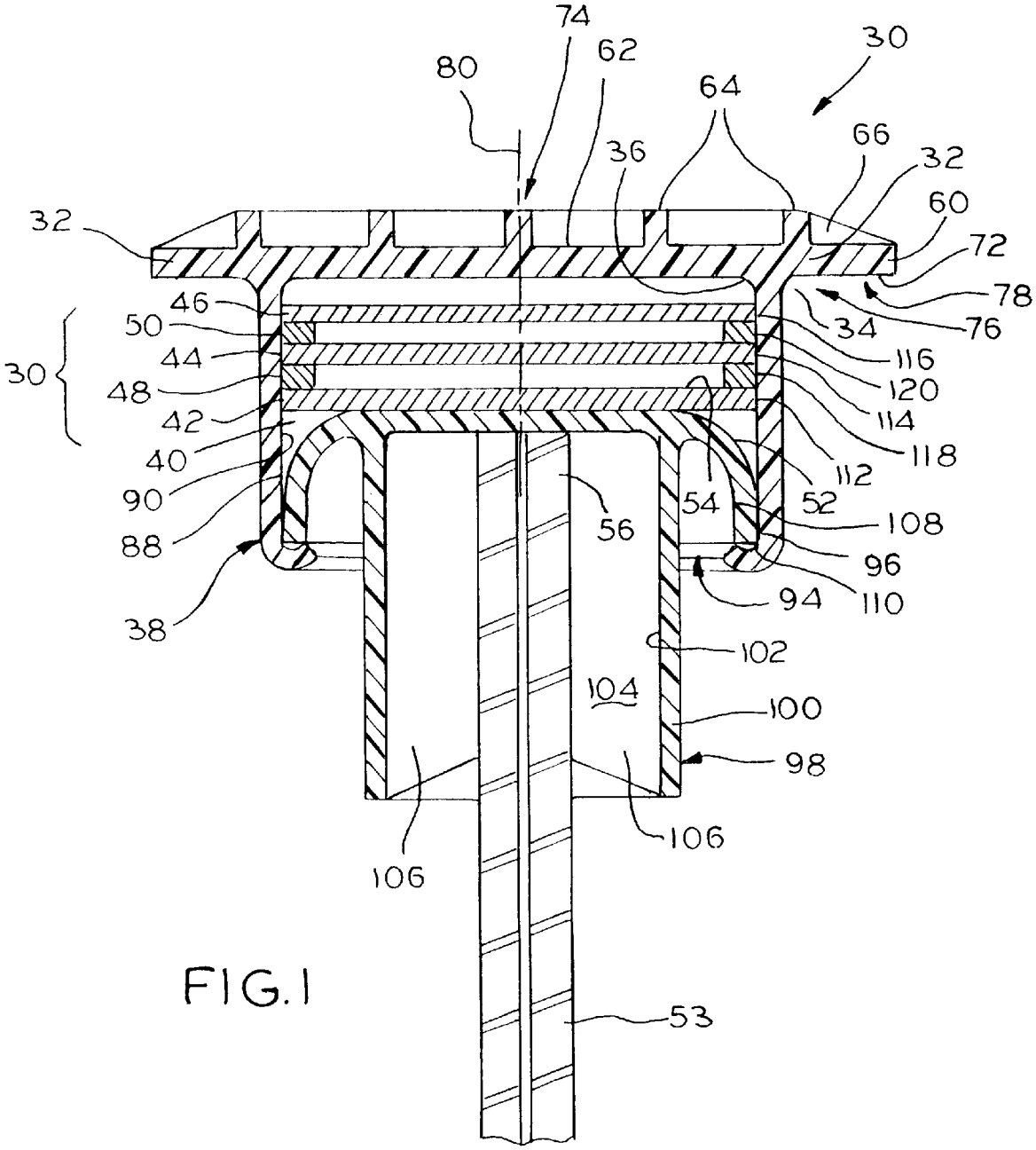
FIG. 1 is a cross-sectional view of an embodiment of a safety system of the present invention.
Figure 2:
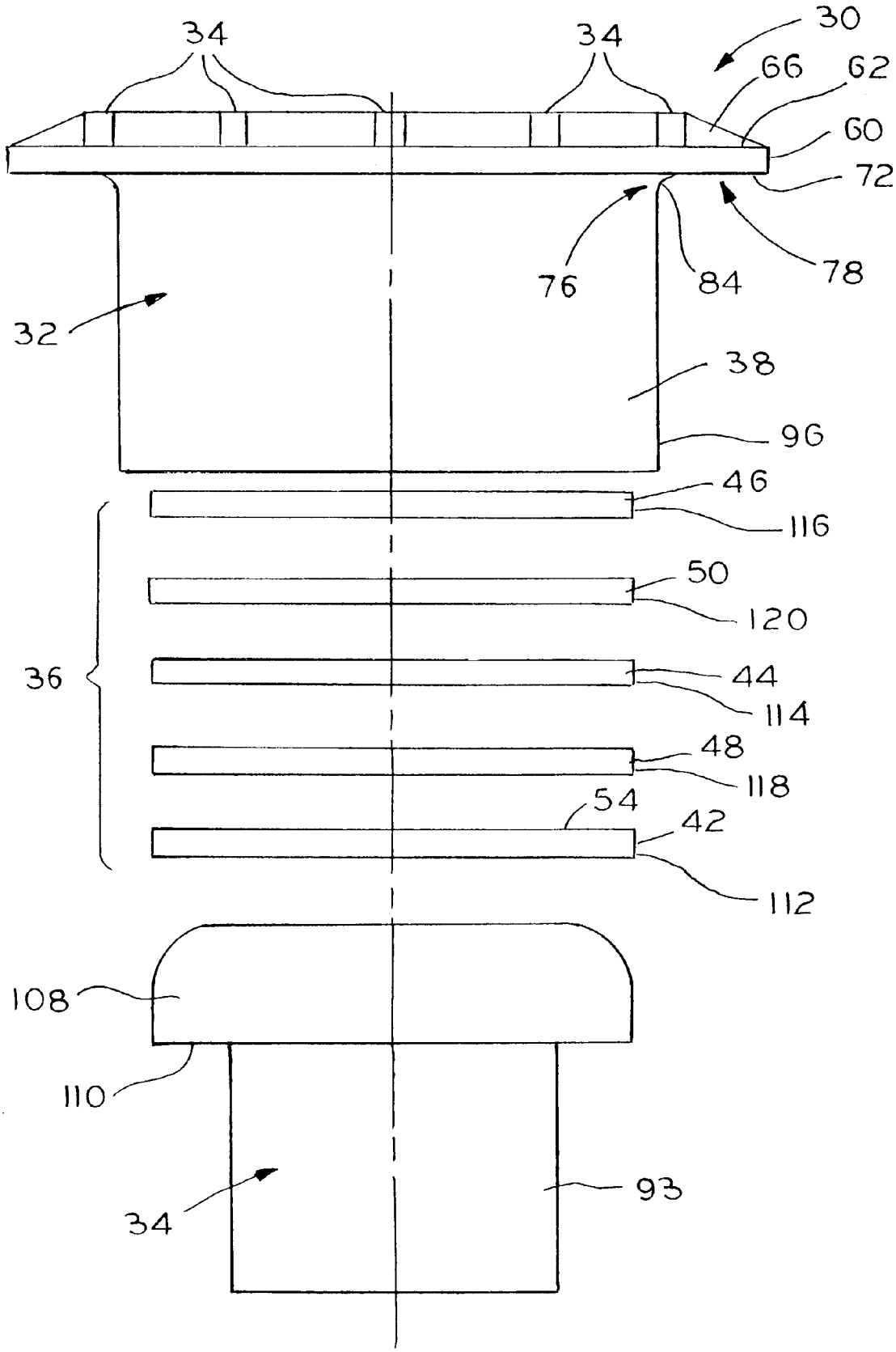
FIG. 2 is an exploded, side view of the safety system of FIG. 1.

A safety system 30 is shown in FIGS. 1 and 2. The safety system 30 includes a cover 32, a support assembly 34 and a dissipator assembly 36 for dissipating the energy generated by the application of a force to the cover 32. The cover 32 and the support assembly 34 are attached through a collar 38 with a space 40 defined therebetween. The dissipator assembly 36, which includes three dissipator plates 42,44, 46 and two spacers 48, 50, is disposed in the space 40. The first dissipator plate 42 is disposed against an upper surface 52 of the support assembly 34, the first spacer 48 upon an upper surface 54 of the first dissipator plate 42, and so on with the spacers 48, 50 disposed between the dissipator plates 42, 44, 46.

In operation, the support assembly 34 is attached to a first effective end 56 of a rebar 58 (i.e. the region of the rebar 58 adjacent to, but not necessarily immediately adjacent to, the distalmost portion of the rebar 58) to hold the system 30 in an operative position relative to the end 56 of the rebar 58. If a force is applied to the cover 32 so as to move the cover 32 in the direction of the rebar 58, then the dissipator plates 42, 44, 46 are designed to rupture under the force applied, rather than resist penetration. In this fashion, the energy generated by the force applied is dissipated, allowing impalement to be prevented.

Figure 3:
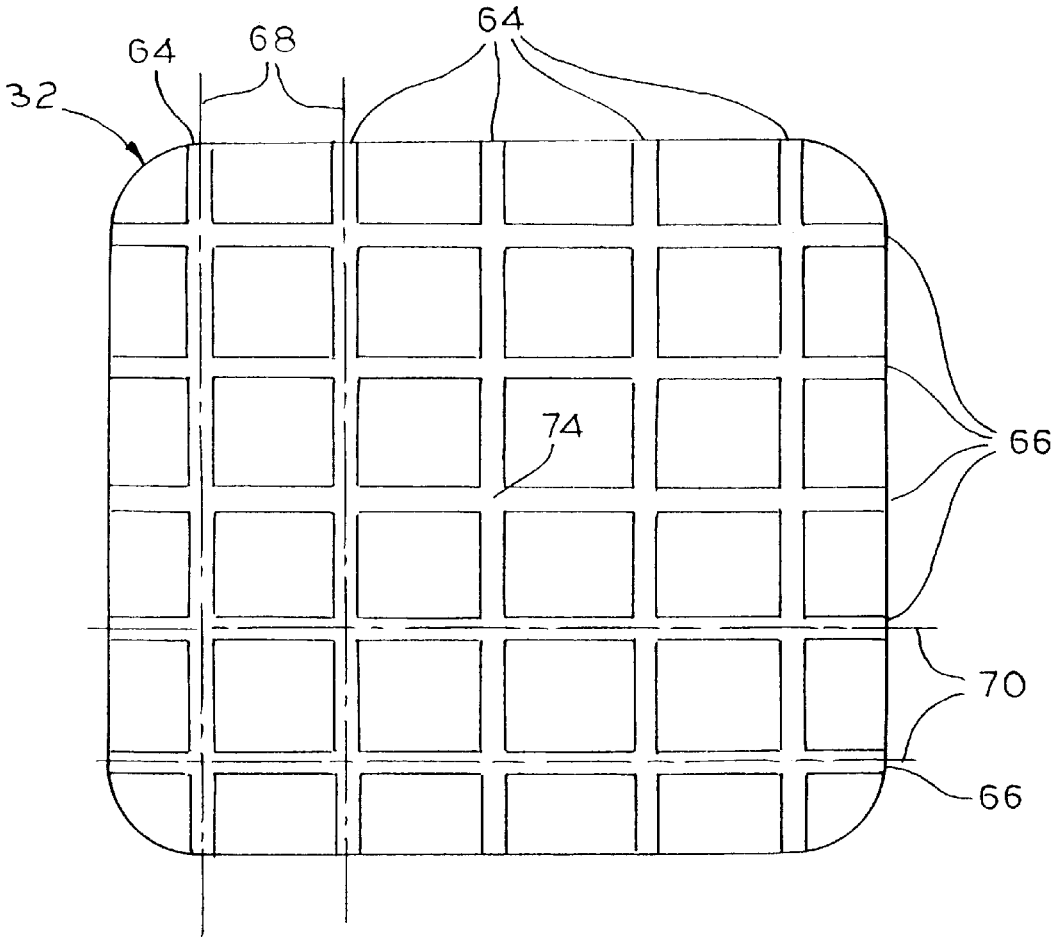
FIG. 3 is a top view of the cover of the safety system of FIG. 1.

The system 30 is now discussed in greater detail starting with the cover 32. As seen in FIG. 3, the cover 32 has a rectangularly-shaped cover base plate 60 with a first surface 62 on which intersecting ribs 64, 66 are overlaid. The ribs 64 are laid along axes 68 which are transverse to axes 70 along which ribs 66 are laid. As shown, the axes 68 are orthogonal to the axes 70, but the angle between axes 68, 70 could be more than or less than 90 degrees. As also shown, the ribs 64, 66 are formed with the cover base plate 62, although the ribs 64, 66 could have been overlaid separately onto base plate 62. The ribs 64, 66 assist in supporting and reinforcing edges 72 of the cover base plate 60 which extend beyond the collar 38 so as to prevent the edges 72 from being broken off from the remainder of the cover base plate 60 if the forces acting on the cover 32 are disposed remotely from a center 74 of the cover 32.

The collar 38 is cylindrically-shaped, and is attached at a first end 76 to a second surface 78 of the cover base plate 60 with a central axis 80 thereof aligned with the center 74 of the base plate 60. At a junction 82 of the collar 38 and the cover base plate 60, fillets 84, 86 may be provided to lessen the stresses which are transmitted through the junction 82 with the application of a force at the edges 72 of the cover base plate 60. The collar 38 also has a wall 88 with an inner surface 90, the inner surface 90 and the second surface 78 of the cover base plate 60 defining the space 40 therebetween with an open end 94. The collar 38 also has a rim 96 at the open end 94 which is deformed to attach the support assembly 34 to the cover 32, for example by heat staking.

The support assembly 34 may be of a standard mushroom shape, as shown. The support assembly 34 includes a cylindrical collar or stem 98 with a wall 100 with an inner surface 102 which defines a bore 104 and to which fins 106 are attached. A cap 108 is attached to the stem 98. The upper surface 52 of the support assembly 34 is defined by the cap 108, while an edge 110 of the cap 108 abuts the deformed rim 96 to attach the support assembly 34 to the cover 32 with the cap 108 in the space 40. The fins 106 abut the end 56 of the rebar 58 to secure the support assembly 34 in an operative position on the rebar 58.

Figure 4:
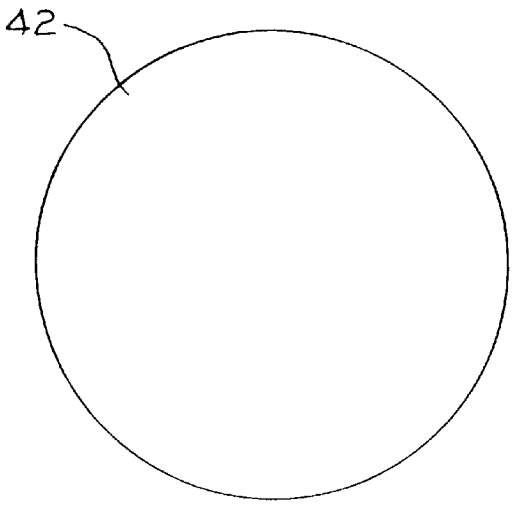
FIG. 4 is a top view of one of the dissipator plates of the safety system of FIG. 1.
Figure 5:
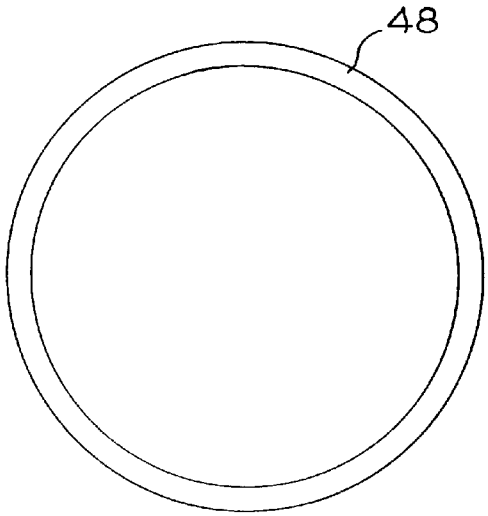
FIG. 5 is a top view of one of the spacers of the safety system of FIG. 1.

As mentioned previously, the dissipator assembly 36 includes a series of dissipator plates 42, 44, 46 and spacers 48, 50. An outermost edge 112, 114, 116 of the cylindrically-shaped dissipator plates 42, 44, 46 (see FIG. 4) abuts the inner surface 90 of the collar 38 to center the dissipator plates 42, 44, 46 within the space 40 (see FIG. 1). The spacers 48, 50, which separate the dissipator plates 42, 44, 46, are ring-shaped (see FIG. 5), and have edges 118, 120 which abut the inner surface 90 to center the spacers 48, 50 in the space 40 (see FIG. 1).

The dissipator plates 42, 44, 46 are made of a material having a greater strength than the material from which the cover 32/collar 38 and support assembly 34 are made. As the cover 32/collar 38 and the support assembly 34 may be made from plastic using an injection-molded process, the dissipator plates 42, 44, 46 may be formed from a material such as steel. While the dissipator plates 42, 44, 46 may all be made of materials having the same strength, the dissipator plates 42, 44, 46 may be made of materials having different strengths. For example, the dissipator plates 42, 44, 46 may be made of materials having successively higher strengths or having varying thicknesses, to thereby limit the chances that the dissipator plate 46 will rupture under a given load, while maximizing the chances that the dissipator plate 42 will rupture, and thereby dissipate some of the energy generated by the movement of the cover 32 in the direction of the support assembly 34. The spacers 48, 50 may be made of steel as well, although the spacers 48, 50 could be made of plastic, for example.

To assemble the system 30, the dissipator plate 46 is disposed into the space 40 defined by the inner surface 90 of the wall 88 of the collar 38 and the surface 78 of the cover base plate 60. The spacer 50 is then disposed on top of the dissipator plate 46, followed by the dissipator plate 44. This step is then repeated with the spacer 48 and the plate 42. The support assembly 34 is then disposed with the cap 108 in the space 40 so that the surface 52 abuts the surface 54 of the dissipator plate 42. The rim 96 of the collar 38 is then deformed over the edge 110 of the cap 108 of the support assembly 34 to secure the support assembly 34 to the cover 32.

In operation, the system 30 is attached to the end 56 of the rebar 58 by disposing the rebar 58 into the bore 104 of the stem 98 of the support assembly 34 (see FIG. 1). The fins 106 abut the end 56 of the rebar 58, and support the system 30 in an operative position on the rebar 58.

If a large object falls onto the system 30 as attached to the end 56 of the rebar 58, the cover 32 moves in the direction of the rebar 58. Rather than causing the end 56 of the rebar 58 to move relative to the dissipator plate 42, the dissipator plate 42 deforms and ruptures if the force applied exceeds a predetermined level to dissipate the energy generated by the force applied. Movement of the end 56 relative to the plate 44 is also resisted through the cooperation of the end 56 and the sides of the hole ruptured in the dissipator plate 42. If the rupture of the dissipator plate 42 is insufficient to dissipate all of the energy generated by the force applied, then the dissipator plate 44 is provided to either contain the remaining forces through deformation, or to dissipate further energy by rupturing and allowing the end 56 of the rebar 58 to penetrate through the dissipator plate 44. Likewise, if the rupturing of the dissipator plate 44 is insufficient to dissipate the energy applied thereto, then the third dissipator plate 46 is provided to absorb the remaining energy through deformation, thereby preventing the rebar 58 from penetrating the cover 32. If the dissipator plate 46 also ruptures, a slight gap 121 is provided before the end 56 is allowed to contact, and possibly rupture, the cover 32.

Figure 6:
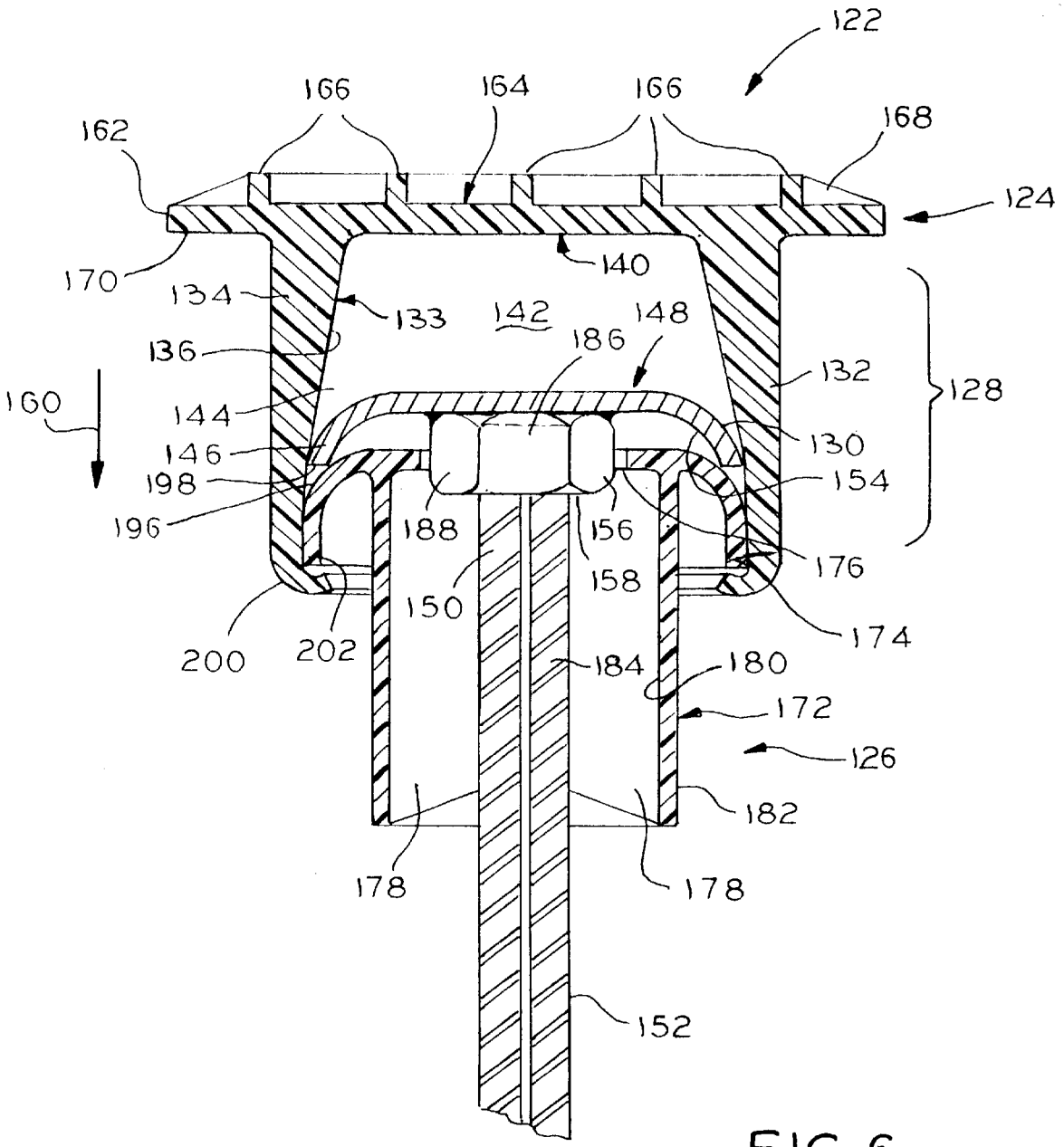
FIG. 6 is a cross-sectional view of another embodiment of a safety system of the present invention.
Figure 7:
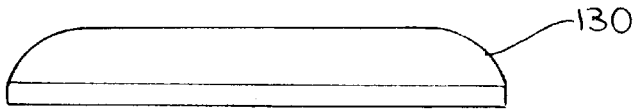
FIG. 7 is a side view of the base plate of the barrier assembly shown in FIG. 6.
Figure 8:
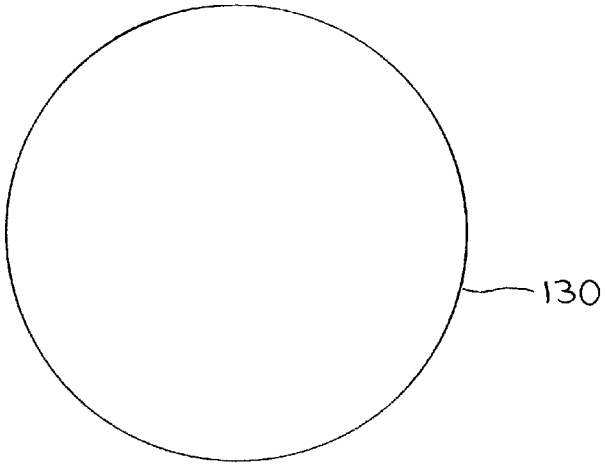
FIG. 8 is a top view of the base plate of the barrier assembly shown in FIG. 7.

Another safety system 122 is shown in FIG. 6. The safety system 122 also includes a cover 124, a support assembly 126 and a dissipator assembly 128. The dissipator assembly 128 includes a dissipator plate 130 (see FIGS. 7 and 8) and a collar 132 having a wall 134 with an inner surface 136 which defines a tapered bore 138 and which with a surface 140 of the cover 124 to which the collar 132 is attached defines a frusto-conical space 142. The dissipator plate 130 is disposed at the base 144 of the frusto-conical space 142 with an outer edge 146 abutting the inner surface 136 of the collar wall 134. The dissipator plate 130 also forms part of a barrier assembly 148 which limits the movement of an end 150 of a rebar 152 along a surface 154 of the dissipator plate 130 through the provision of a barrier wall 156 which has a surface 158 substantially transverse to the surface 154 of the dissipator plate 130.

In operation, a force applied to the cover 124 causes the cover 124 to move in the direction (as shown by an arrow 160 in FIG. 6) of the end 150 of the rebar 152. As the cover 124 moves in the direction of the arrow 160, the collar 132 is moved in the direction of the end 150 of the rebar 152, while relative motion of the dissipator plate 130 is in the opposite direction through space 142. As the dissipator plate 130 moves through the space 142, the edge 146 of the dissipator plate 130 drags along the inner surface 136 of the collar 132 to dissipate energy through friction and deformation. The dissipation of energy through friction and deformation assists in preventing the rebar 152 from being bent through contact with a stiff, unyielding obstacle. Furthermore, the barrier wall 156 restricts the movement of the end 150 on the surface 154 relative to the dissipator plate 130.

The structure of the system 122 is now discussed in greater detail. As in the system 98, the cover 124 includes a cover base plate 162 with a surface 164 overlaid with ribs 166, 168, similar to those shown in FIG. 2. The ribs 166, 168 serve to reinforce edges 170 of the cover 124 which extend beyond the collar 132.

The collar 132, unlike the collar 38, performs a more substantial role in the dissipator assembly 128. As mentioned above, the collar 132 and the dissipator plate 130 cooperate through deformation to dissipate the energy generated when a force is applied to the system 122 causing the cover 124 to move in the direction of the rebar 152. In particular, the collar 132 and the dissipator plate 130 are made of materials of different strengths, for example, plastic and steel, respectively. As a consequence, when the cover 124 is moved in the direction of the rebar 152, the higher strength dissipator plate 130 destructively deforms the wall 134 of the collar 132. Alternatively, the wall 134 of the collar 132 could be made of a material of greater strength than the dissipator plate 130, in which case the plate 130 would deform, rather than the collar 132.

To allow the dissipator plate 130 to move relative to the collar 132 as the cover 124 moves relative to the rebar 152, the mushroom-shaped support assembly 126 is provided with a hollow collar or stem 172 attached to a cap 174 with a hole 176 therethrough. The system 122 is maintained in an operative position through the cooperation of fins 178 attached to an inner surface 180 of a wall 182 of the stem 172 and the outer surface 184 of the rebar 152 with the end 150 depending through the hole 176. The end 150 is thus able to cause the dissipator plate 130 to move relative to the remainder of the system 122, which is moved under the force applied to the cover 124 in the direction of the rebar 152.

Figure 9:
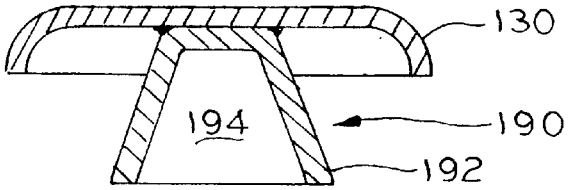
FIG. 9 is a cross-sectional view of an alternative barrier assembly for use in the safety system of FIG. 6.
Figure 10:
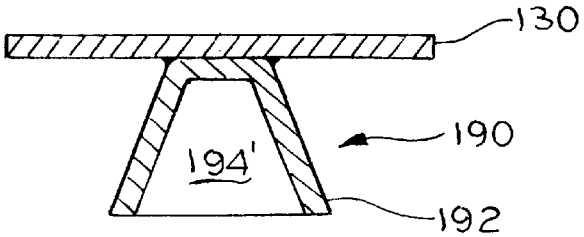
FIG. 10 is a cross-sectional view of another alternative barrier assembly for use in the safety system of FIG. 6.

The end 150 of the rebar 152 disposed through the hole 176 is fitted into a receptacle 186 defined by the barrier wall 156 to prevent the end 150 of the rebar 152 from becoming displaced along the surface 154 of the dissipator plate 130. As shown in FIG. 6, the barrier wall 156 is defined by a nut 188 which is attached to the surface 154, by welding for example. Other alternative structures for the barrier assembly 148 are shown in FIGS. 9 and 10, wherein the barrier wall 156 is defined by cup 190, 190' which has a frusto-conical wall 192, 192' which defines a receptacle 194, 194' which the end 150 of the rebar 152 is restrained. As can be seen in FIGS. 9 and 10, the angle of the surface of the barrier wall to the surface of the barrier base plate need not be 90° to adequately restrict the movement of the end of the rebar relative to the barrier base plate.

The system 122 is assembled by placing the dissipator plate 130 into the frusto-conical shaped space 142, followed by the support assembly 126. The edge 146 of the dissipator plate 130 abuts the inner surface 136 of the collar wall 134 with a surface 196 of the support assembly 126 abutting an edge 198 of the dissipator plate 130. A rim 200 of the collar 132 is deformed over an edge 202 of the cap 162 of the support assembly 126 to attach the support assembly 126 to the cover 124 with dissipator plate 130 in an operative position therebetween in the space 142.

The system 122 is installed on the end 150 of the rebar 152 by disposing the end 150 of the rebar 152 into the support assembly 126, through the hole 176 and into the receptacle 186 (see FIG. 6). The fins 178 abut the rebar 152 to maintain the system 122 in an operative position on the end 150 of the rebar 152. The barrier wall 156 cooperates with the end 150 of the rebar 152 to restrict the movement of the end 150 of the rebar 152 along the surface 154 of the plate 130.

If a force is applied to the cover 124 to move the cover 124 in the direction of the arrow 160, then the cover 124 and collar 132 move downwardly along the rebar 152. The dissipator plate 130, attached to the end 150 of the rebar 152, remains stationary relative to the ground. As a result, the dissipator plate edge 146 drags along and deforms the collar wall 134, thereby dissipating the energy generated by the force applied to the cover 124 and limiting the energy which could cause the rebar 152 to bend. To further ensure that the end 150 of the rebar 152 does not move along the surface 154 of the dissipator plate 130, the barrier wall 156 abuts the end 150 to restrict its movement to the receptacle 186.

Figure 11:
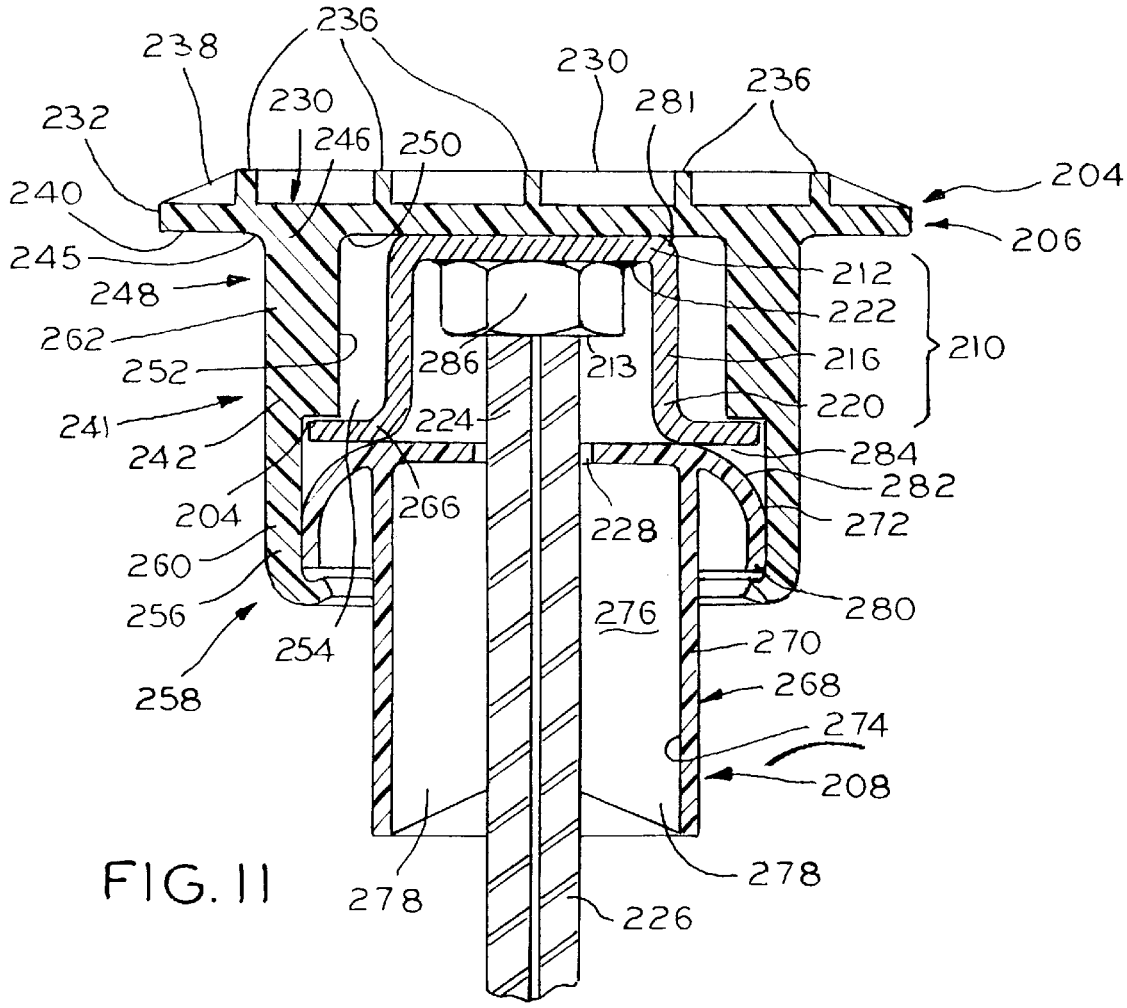
FIG. 11 is cross-sectional view of a further embodiment of a safety system according to the present invention.
Figure 12:
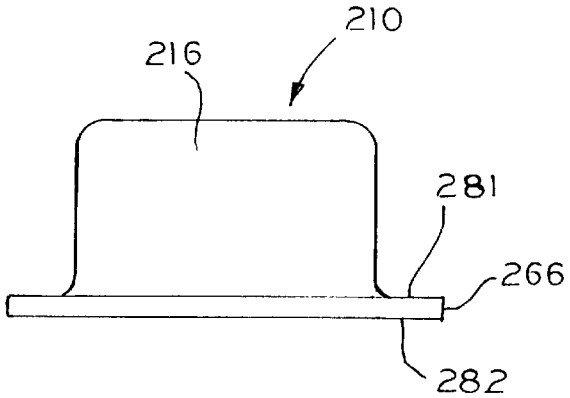
FIG. 12 is a side view of the barrier assembly shown in FIG. 11.
Figure 13:
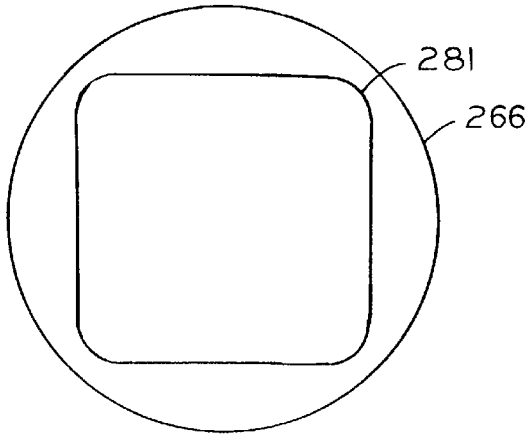
FIG. 13 is a top view of the barrier assembly of FIG. 12.

Still another safety system 204 is shown in FIGS. 11–13. The system 204 includes a cover 206, a support assembly 208 and a barrier assembly 210. The barrier assembly 210 includes a barrier base plate 212, a first barrier wall 214 and a second barrier wall 216, the walls 214, 216 having surfaces 218, 220 transverse to a surface 222 of the barrier base plate 212. The barrier assembly 210 is secured between the cover 206 and the support structure 208.

In operation, an end 224 of a rebar 226 is inserted into the support assembly 208, which maintains the system 204 on the rebar 226 in an operative position. The rebar 226 is passed through a hole 228 in the support assembly 208, and into a receptacle 230 defined by the barrier wall 214. The barrier base plate 212 resists penetration of the cover 206 by the rebar 226, while the barrier walls 214, 216 resist movement of the end 224 relative to the barrier base plate 212.

The system 204 is now discussed in greater detail. The cover 206 includes a cover base plate 232 having a first surface 234 overlaid with ribs 236, 238, similar to those shown in FIG. 3. The ribs 236, 238 serve to reinforce edges 240 of the cover 206 which extend beyond a collar 241.

The collar 241 has a cylindrical wall 242 which is attached at a first end 244 to a surface 245 of the cover base plate 232 at a junction 246. Fillets 248, 250 are provided at the junction 246 to lessen the stresses occurring at the junction 246. The collar wall 242 has an inner surface 252 which with the surface 245 of the cover base plate 232 defines a space 254. A rim 256 at a second end 258 of the collar wall 242 is deformed about the support assembly 208 to attach the support assembly 208 to the cover 206 with the barrier assembly 210 secured therebetween in the space 254.

The collar wall 242 has two sections 260, 262 of varying thickness. The sections 260, 262 meet so as to define an internal shoulder 264. The barrier assembly 212 has a flange-like ridge 266 (see FIGS. 12 and 13) which abuts the shoulder 264 with the barrier assembly 210 disposed within the space 254. The collar 241 and the barrier assembly 210, and in particular shoulder 264 and edge 266 cooperate to dissipate some of the energy generated when a force is applied to the upper surface 234 of the cover 206 with the support assembly 208 attached to a rebar 126.

The support assembly 208, as shown, is of a standard mushroom-shape, including a cylindrical collar or stem 268 with a wall 270 attached to a cap 272. The wall 270 has an inner surface 274 which defines a bore 276 and to which fins 278 are attached to maintain the support assembly 208 in an operative position on the end 224 of the rebar 226. The cap 272 has an edge 280 which cooperates with the rim 256 of the collar 241 to attach the support assembly 208 to the cover 206 with the barrier assembly 210 secured therebetween. The hole 228 passes through the cap 272 to allow the end 224 of the rebar 226 to pass therethrough so as to be received in the receptacle 230 of the barrier assembly 210.

To assemble the system 204, the barrier assembly 210 is disposed into the space 254 with the edge 266 abutting the shoulder 264. So disposed, a surface 281 of the barrier base plate 212 abuts the surface 245 of the cover 206. The support assembly 208 is then disposed into the space 254 with a surface 282 of the cap 272 of the support assembly 208 abutting a surface 284 of the barrier assembly 210. The rim 256 of the collar 241 is then deformed about the edge 280 of the cap 272 of the support assembly 208 to attach the support assembly 208 to the cover 206 with the barrier assembly 210 secured therebetween.

In operation, a distalmost edge 286 of the end 224 of the rebar 226 is passed through the bore 270 of the stem 268, through the hole 228 and into the receptacle 230 (see FIG. 11). The fins 278 support the system 204 in an operative position on the end 224 of the rebar 226. If a force is applied to the system 204 so disposed on the end 224 of the rebar 226, then some of the energy generated thereby is dissipated through the cooperation of the edge 266 of the plate 212 and the shoulder 264 of the collar 241. Additionally, movement of the end 224 relative to the surface 222 is resisted by barrier walls 214, 216, and specifically the surfaces 218, 220.

Figure 14:
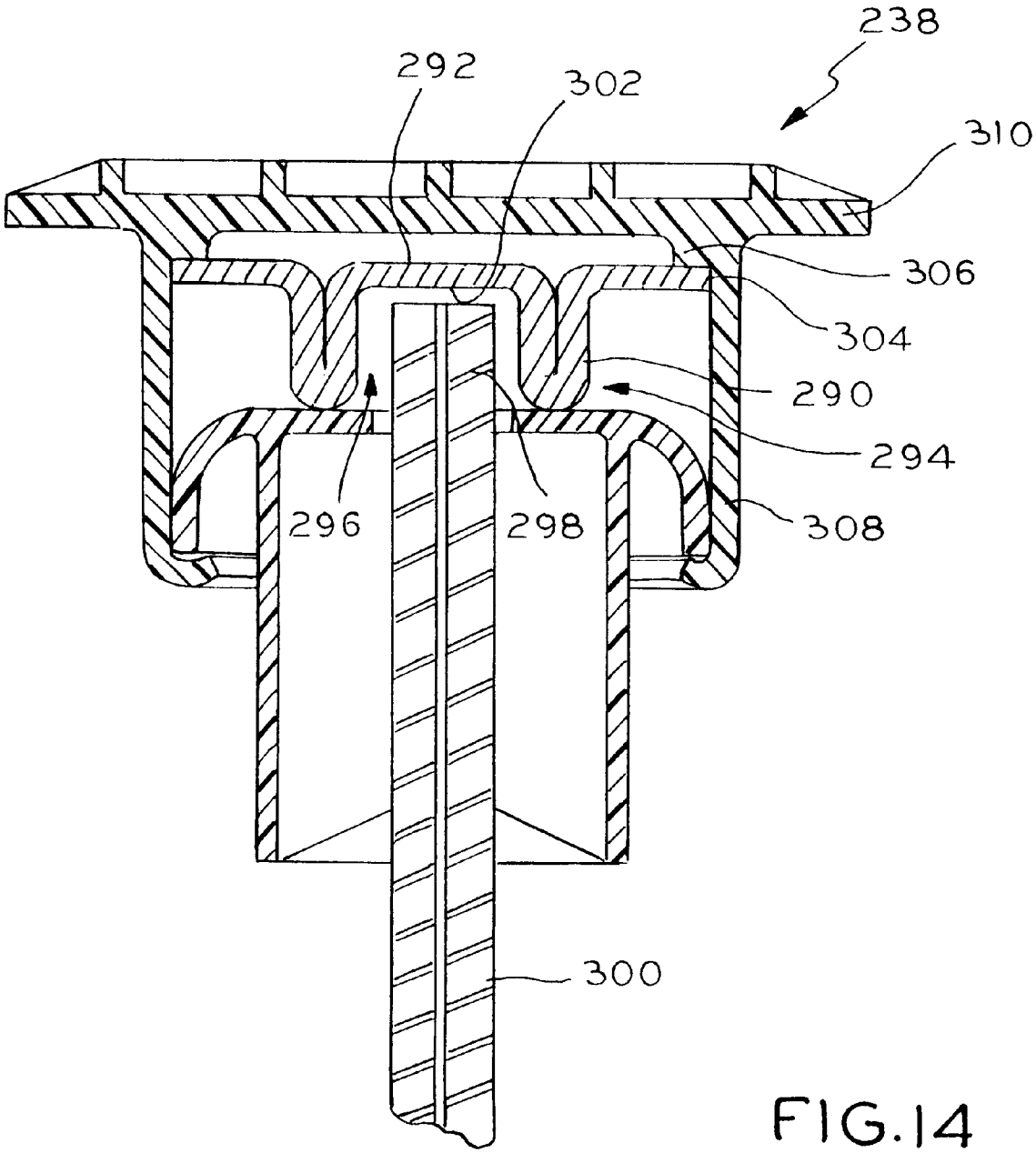
FIG. 14 is a cross-sectional view of still another safety system according to the present invention.

One of ordinary skill in the art will recognize that the use of a nut in the aforementioned barrier assemblies adds to the cost of the system. Additionally, the use of the nut adds to the pre-assembly manufacturing steps for the systems. Therefore, a safety system 288 is shown in FIG. 14 with a barrier assembly 289 wherein the nut shown in FIGS. 6 and 11 is replaced with a barrier wall 290 drawn from a barrier base plate 292 in such a manner as to form a central cylindrical hub with a receptacle 296 formed therein. An end 298 of a rebar 300 is received in the receptacle 296 so as to prevent the end 298 from moving along a surface 302 of the barrier base plate 292. Additionally, an edge 304 of the base plate 292 abuts against a shoulder 306 of the collar 308 so as to cooperate to dissipate some of the energy generated when a force is applied to the cover 310 in the direction of the end 298 of the rebar 300.

Figure 15:
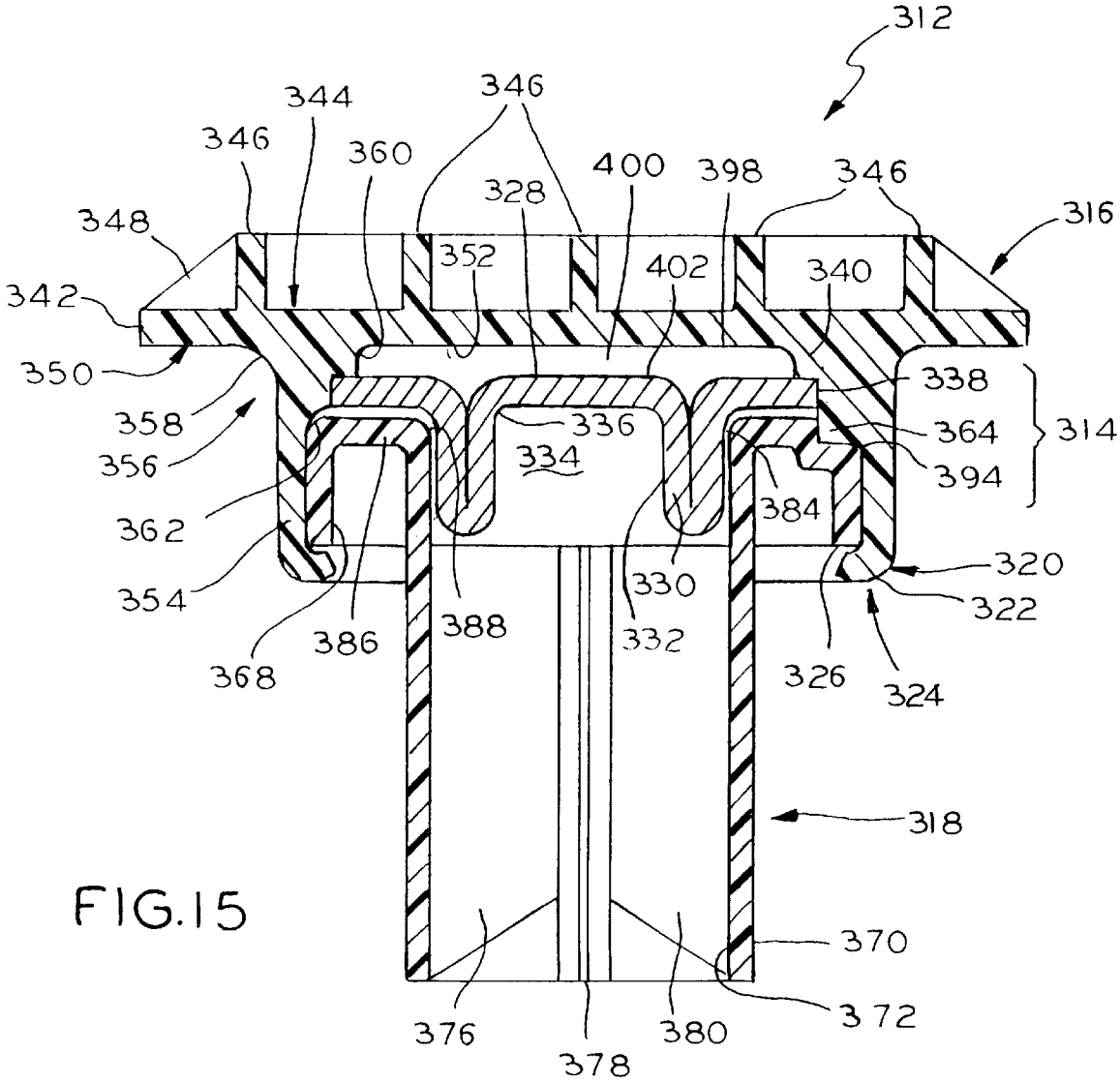
FIG. 15 is a cross-sectional view of yet another safety system according to the present invention.

A further safety system 312 is shown in FIG. 15 including barrier assembly 314 similar to the barrier assembly 289 shown in FIG. 14. The safety system 312 also includes a cover 316 and a support assembly 318. A collar 320 depends from the cover 314, and has a rim 322 at one end 324 deformed about an edge 326 of the support assembly 318 to attach the support assembly 318 to the cover 316 with the barrier assembly 314 secured therebetween. The barrier assembly 314 includes a barrier base plate 328 drawn to form a barrier wall 330 with a surface 332 which defines a receptacle 334 to receive an end of a rebar therein to restrict the movement of the end of the rebar along a surface 336 of the base plate 328. Additionally, the barrier base plate 328 has an edge 338 which cooperates with a shoulder 340 of the collar 320 to dissipate some of the energy generated when a force is applied to the cover 316.

The safety system 312 is now discussed in greater detail. In particular, the cover 316 has a cover base plate 342 with a first surface 344 overlaid with intersecting ribs 346, 348, which act to reinforce edges 350 which depend beyond the collar 320. The cover base plate 342 also has a surface 352 to which a wall 354 of the collar 320 is attached at a first end 356. Fillets 358, 360 are provided at the junction to reduce the stresses thereat. The collar 320 has an inner surface 362 which is stepped to define the shoulder 340, as well as a shoulder 364, the purpose of which is mentioned below.

The support assembly 318 is similar to those previously mentioned in that it generally has a mushroom-shape with a collar or stem 366 and a cap 368, and the stem 366 has a wall 370 with an inner surface 372 which defines a bore 374 to which fins 376, 378, 380, 382 are attached. However, unlike the support assemblies previously mentioned, the bore 374 has a diameter equal to that of a circular hole 384 formed in an upper wall 386 of the cap 368 (see FIGS. 16 and 17). The bore 374 and the fins 376, 378, 380, 382 are sized to accommodate the hub-like barrier wall 330 of the barrier assembly 314 which is disposed through the hole 384 during assembly of the system 312. Additionally, the surface 388 of the upper wall 386 is not uniformly shaped, but has a series of grooves 390, 392, 394, 396 formed therein, as shown in FIG. 17. The grooves 390, 392, 394, 396 cooperate with the shoulder 364 of the collar 320 to resist the rotational movement of the support assembly 318 relative to the cover 316 about its axis.

To assemble the system 312, the barrier assembly 314 is placed within a space 398 defined by the surfaces 352, 362, with the edge 338 of the barrier assembly 314 abutting the shoulder 340. It should be noted that even with the edge 338 abutting the shoulder 340, a gap 400 exists between a surface 402 of the barrier base plate 328 and the surface 352 of the cover 316, allowing the barrier assembly 314 to deform without penetrating the cover 316, thereby further dissipating energy generated by a force contacting the cover 316. The support assembly 318 is placed into the collar 320 with the upper wall 386 of the support assembly 318, and in particular the surface 388, abutting the surface 336 of the barrier base plate 328. The rim 322 of the collar 320 is then deformed to attached the support assembly 318 to the cover 316 with the barrier assembly 314 secured therebetween.

In operation, an end of a rebar is inserted through the bore 374 of the stem 366 of the support assembly 318, through the hole 384 in the cap 368, and into the receptacle 334 of the barrier assembly 314. The fins 376, 378, 380, 382 assist in maintaining the system 312 on the rebar in an operative position. If a force is applied to the cover 316, then the barrier assembly 314 and the cover 320 will cooperate along the edge 338 and the shoulder 340 to dissipate a portion of the energy generated thereby. Further, the barrier assembly 314 may deform into the gap 400, thereby dissipating further energy. To restrict movement of the end of the rebar along the surface 336, the barrier wall 330 acts to restrict the movement of the rebar end to the receptacle 334.

Figure 18:
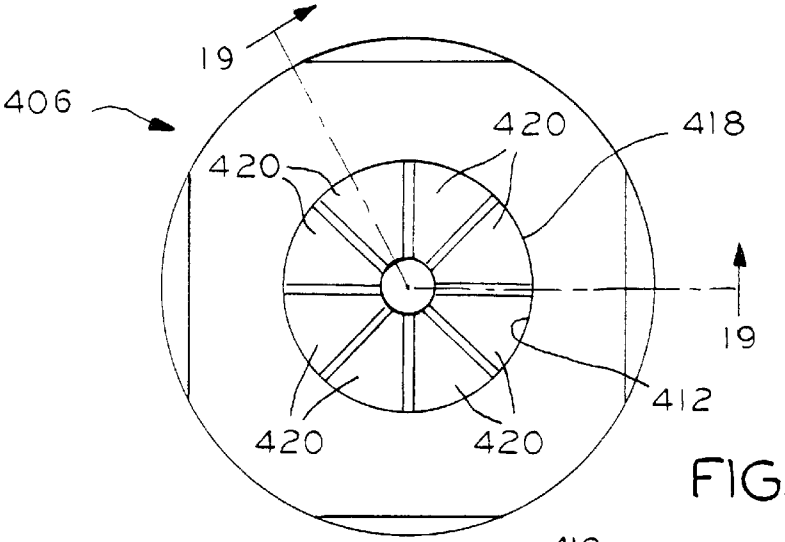
FIG. 18 is a top view of an alternative support assembly for use in the safety system of FIG. 15.
Figure 19:
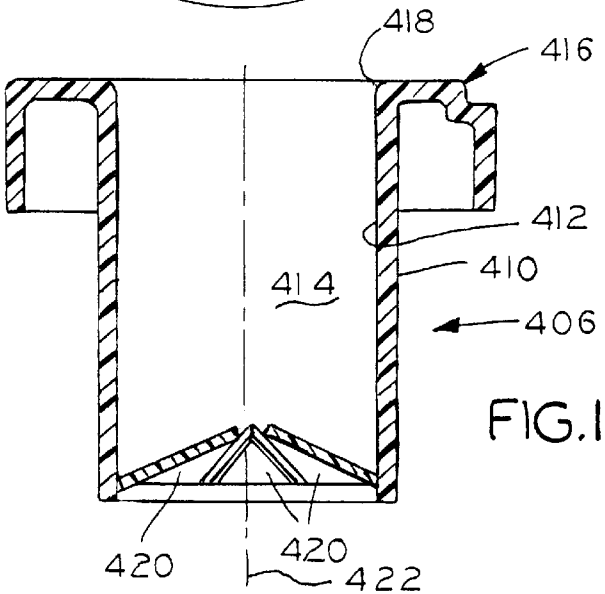
FIG. 19 is a cross-sectional view of the support assembly shown in FIG. 18 taken along line 19—19.
Figure 16:
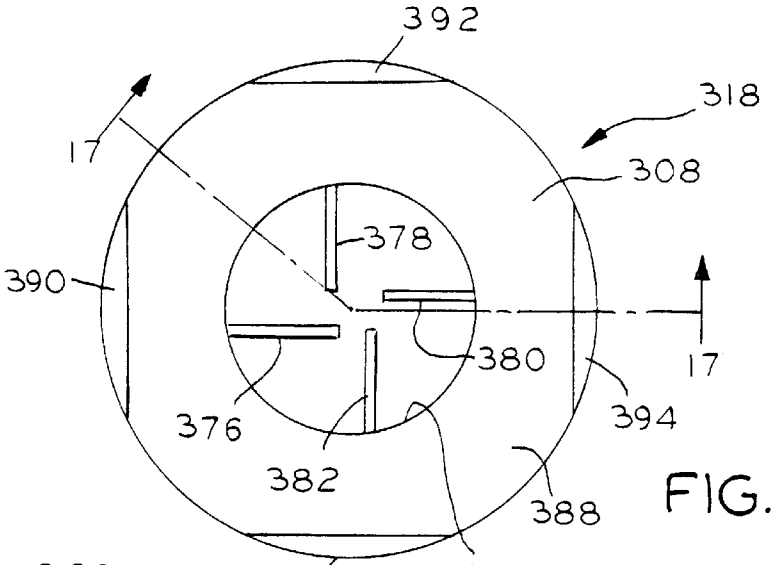
FIG. 16 is a top view of the support assembly shown in FIG. 15.
Figure 17:
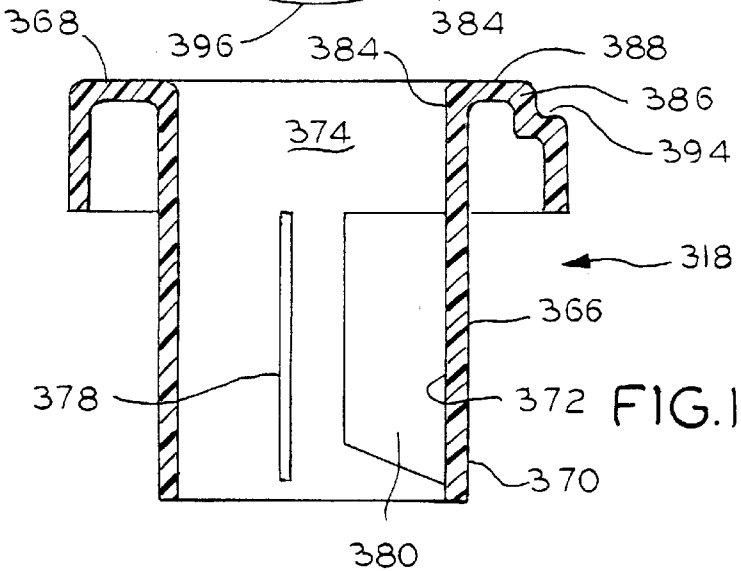
FIG. 17 is a cross-sectional view of the support assembly of FIG. 16 taken along line 17—17.

While one support assembly 318 is shown in FIGS. 15–17, numerous other support assemblies can be designed, as recognized by one of ordinary skill in the art, to maintain the impalement prevention system 312 in an operative position on an end of a rebar. For example, a support assembly 406 is shown in FIGS. 18–19. The support assembly 406 has a collar or stem 408 with a wall 410 having an inner surface 412 defining a bore 414 and a cap 416 with a hole 418 being roughly the same diameter as the bore 414 of the stem 408. However, instead of fins oriented parallel to an axis of the collar 408, such as is shown in FIGS. 16 and 17, the support assembly 406 has fins 420 which are disposed generally transverse to an axis 422 of the collar 408.

Figure 20:
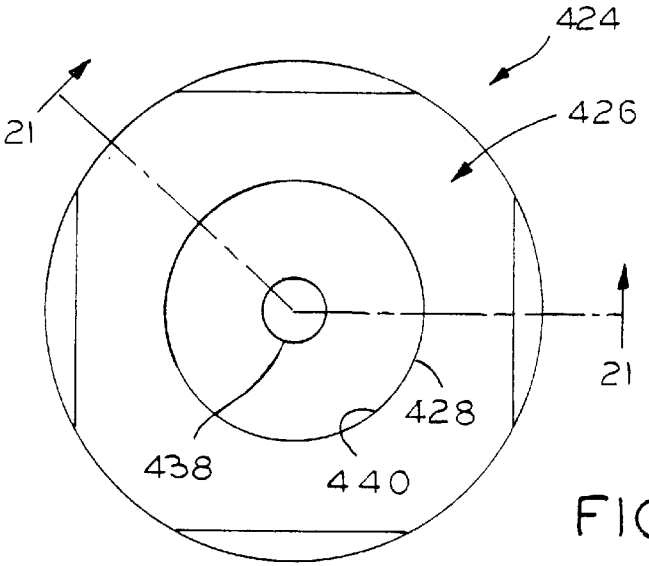
FIG. 20 is a top view of another alternative support assembly for use in the impalement prevention system of FIG. 15.
Figure 21:
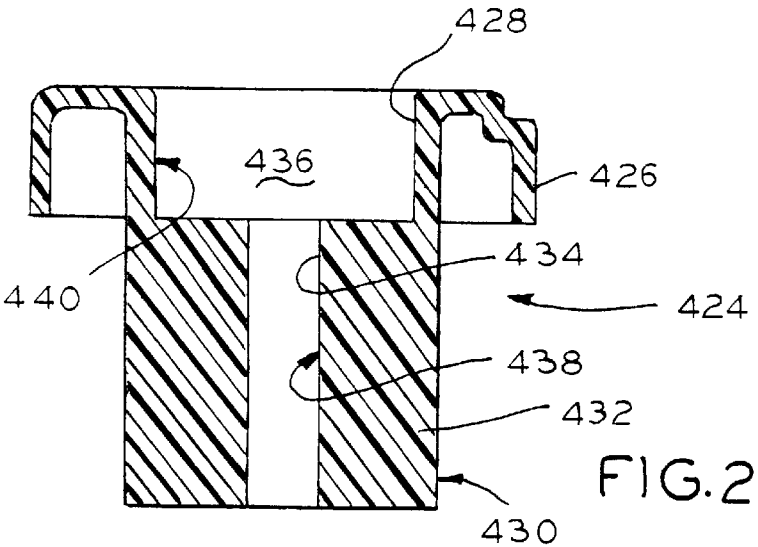
FIG. 21 is a cross-sectional view of the support assembly shown in FIG. 20 taken along line 21—21.

Another support assembly 424 is shown in FIGS. 20 and 21. The support assembly 424 has a cap 426 with a hole 428 formed therein to receive a hub-like barrier wall similar to the hub-like barrier wall 330 shown in FIG. 15, and a stem 430 with a wall 432 having an inner surface 434 defining a bore 436. The bore 436 has a first section 438 with a diameter less than the hole 428 but slightly larger than the diameter of a rebar with which the support assembly 424 is to be used. The bore 436 also has a second section 440 having a diameter equal to the hole 428 and a depth equal to the height of the wall 330 of the barrier assembly 314 with which the support assembly 424 is to be used.

Figure 22:
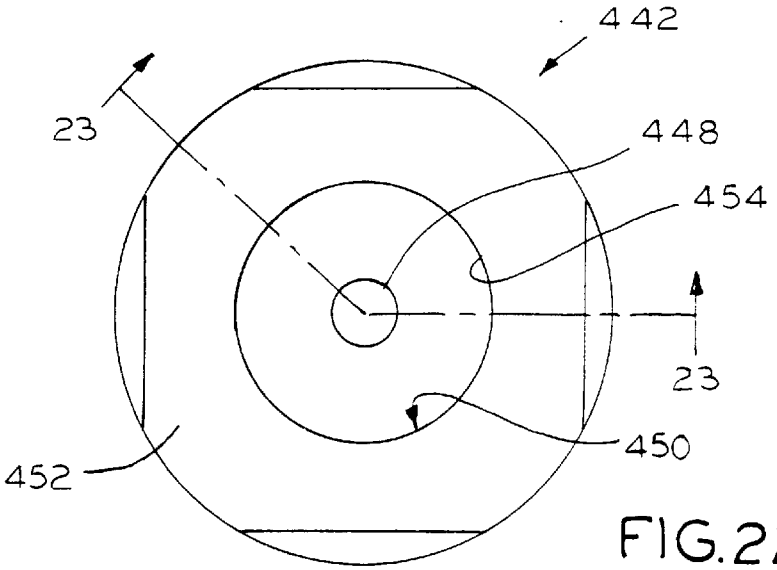
FIG. 22 is a top view of yet another support assembly for use in the safety system of FIG. 15.
Figure 23:
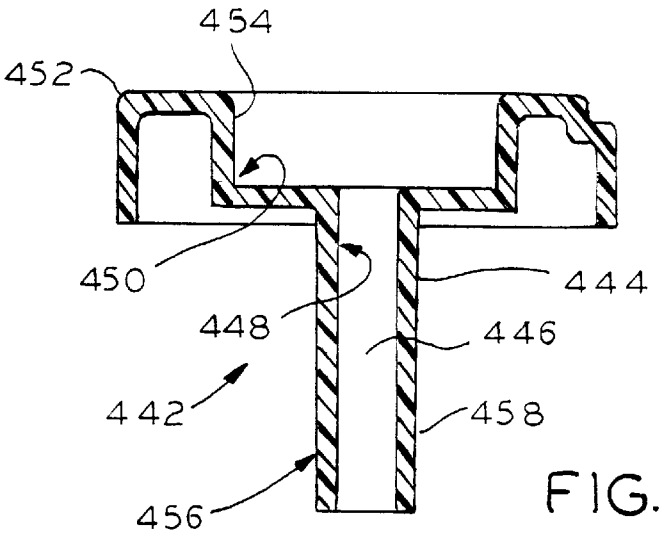
FIG. 23 is a cross-sectional view of the support assembly shown in FIG. 22 taken along line 23—23.

A modified support assembly 442, based on the support assembly 424, is shown in FIGS. 22 and 23. The support assembly 442 has a stem 444 with a bore 446 in two sections 448, 450 and a cap 452 with a hole 454, similar to the support assembly 424. However, unlike the support assembly 424, the support assembly 442 does not have an external surface 456 which is generally uniform, but rather contoured to provide a stem wall 458 of uniform thickness.

Figure 24:
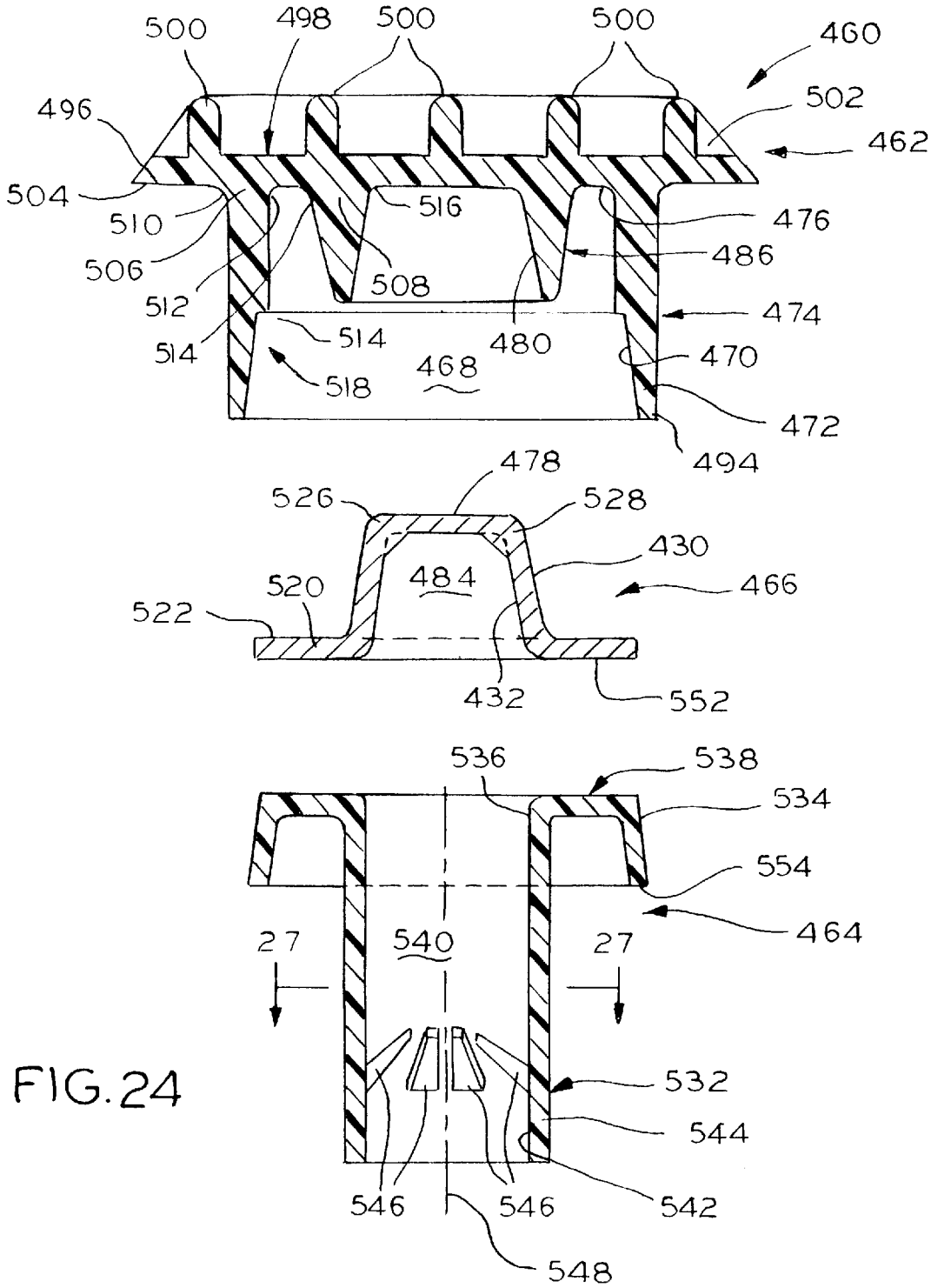
FIG. 24 is an exploded, cross-sectional view of a further embodiment of a safety system according to the present invention.
Figure 25:
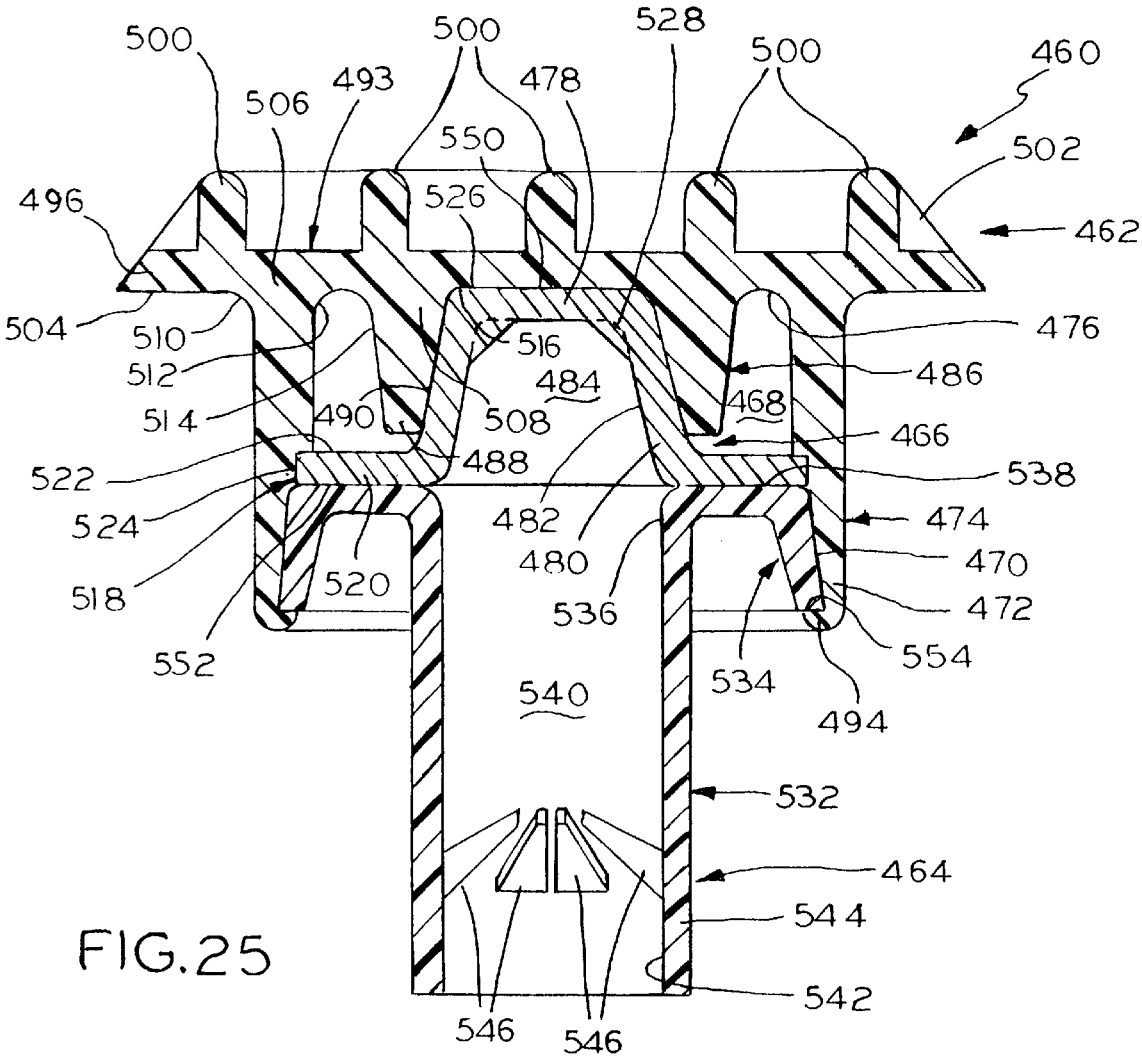
FIG. 25 is an assembled, cross-sectional view of the safety system of FIG. 24.

A further safety system 460 is shown in FIGS. 24–25. The safety system 460 includes a cover 462 and a support assembly 464. A barrier assembly 466 is secured between the cover 462 and the support assembly 464, with the barrier assembly 466 and the support assembly 464 disposed within a space 468 defined by a surface 470 of a wall 472 of an outer collar 474 and a surface 476 of the cover 462. In particular, the barrier assembly 466 includes a base plate 478 stamped to form a first wall 480 having a surface 482 which defines a recess 484 for receiving an end of a rebar therein. An inner collar 486 having a wall 488 with a surface 490 defines with the surface 476 a receptacle 492 for receiving the wall 480 of the barrier assembly 466 with the barrier assembly 466 disposed in the space 468. A rim 494 of the outer collar 474 is deformed to attach the support assembly 464 to the cover 462 with the barrier assembly 466 secured between the cover 462 and the support assembly 464.

The cover 462 includes a cover base plate 496 having a surface 498 overlaid with reinforcing ribs 500, 502. The intersecting ribs 500, 502 reinforce the edges 504 of the cover base plate 496 to prevent the edges 504 from being broken off by, for example, a force applied to the cover 462 at the edges 504.

The collars 474, 486 are attached to the cover base plate 496. At the junctures 506, 508 between the collars 474, 486 and the cover base plate 496, fillets 510, 512, 514, 516 are provided to relieve the stress which can develop at the junctures 506, 508. This is especially significant for junctures 506, as sizeable stresses can be generated at these junctures if a force is applied to the edges 504 of the cover base plate 496.

The wall 472 of the outer collar 474 is stepped to provide a shoulder 518 against which a flange-like edge 520 of the plate 466 abuts with the wall 480 of the barrier assembly 466 disposed within the receptacle 492. In particular, a surface 522 of the flange-like edge 520 abuts a surface 524 of the shoulder 518 (see FIG. 25). The shoulder 518 and the edge 520 cooperate to dissipate a portion of the energy generated when a force is applied to the cover 462.

Figure 26:
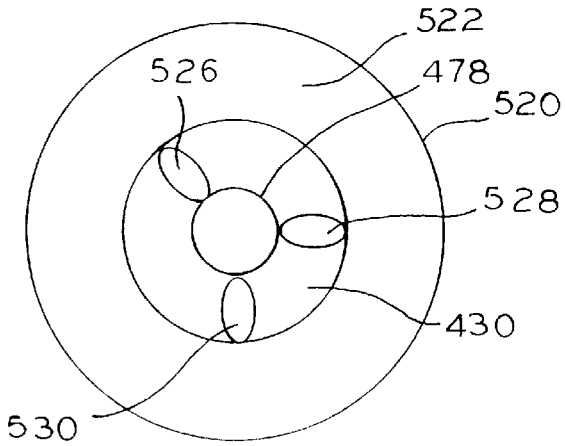
FIG. 26 is a top view of the barrier assembly shown in FIG. 24.

The barrier assembly 466, in addition to the wall 480 and the edge 520, has a series of gussets 526, 528, 530 formed therein (see FIG. 26). The gussets 526, 528, 530 are used to reinforce the wall 480. While three gussets 526, 528, 530 are shown, any number of gussets may be used.

Figure 27:
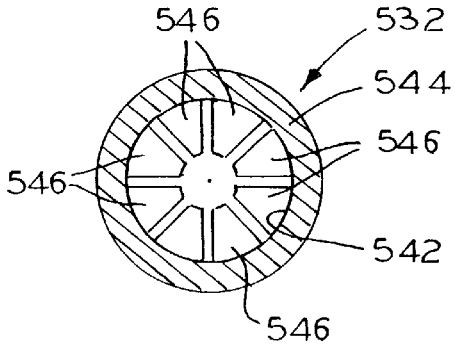
FIG. 27 is a cross-sectional view of the support assembly shown in FIG. 24 taken along line 27—27.

The support assembly 464 is similar to the other support assemblies discussed above in that the support assembly 464 is mushroom-shaped, with a stem 532 and a cap 534. The cap 534 has a hole 536 defined in an upper surface 538 thereof. The hole 536 is connected to a bore 540 defined by an inner surface 542 of a wall 544 of the stem 532, the bore 540 having a diameter equal to that of the hole 536, as shown. Fins 546 are attached to the inner surface 542, and, as shown, extend from the wall 544 of the stem 532 transversely to an axis 548 of the support assembly 464 (see FIG. 27).

The support assembly 464 is shown without a groove or grooves cooperating with a shoulder of the collar 474 to resist movement of the support assembly 464 relative to the collar 474 about its axis 548. Alternatively, such a groove/shoulder combination may be added to the support assembly 464 and collar 474, as shown in FIGS. 15–23.

To assemble the system 460 (as shown in FIG. 25), the barrier assembly 466 is disposed within the space 468 such that a surface 550 of the base plate 478 is disposed against the surface 476 of the cover 462. So disposed, the surface 522 of the edge 520 abuts the surface 524 of the shoulder 518 of the collar 474. The cap 534 of the support assembly 464 is also disposed within the space 468 such that the surface 538 abuts a surface 552 of the edge 520. The rim 494 of the outer collar 474 is then deformed about an edge 554 of the support assembly 464 to attach the support assembly 464 to the cover 462 with the barrier assembly 466 secured therebetween.

In operation, an end of a rebar is disposed through the space 468 and the hole 536 into the receptacle 492 defined by the barrier wall 480. The fins 546 abut the end of the rebar to maintain the system 460 in an operative position on the end of the rebar. If a force is applied to the cover 462 of the system 460, then the flange-like edge 520 and the shoulder 518 cooperate to dissipate a portion of the energy generated by the application of the force to the cover 462. Additionally, the wall 480 restricts the movement of the end of the rebar along the base plate 478 and through the inner and outer collars 474, 486.

Still other aspects, objects, and advantages of the present invention can be obtained from a study of the specification, the drawings, and the appended claims.

I claim:

1. A safety system for use with a concrete reinforcing bar or rebar comprising:

a cover having a cover base plate with a first surface for receiving a force and a second surface;

a collar having a collar wall attached to the second surface of the cover base plate and having an inner surface defining a bore;

means attached to the collar wall for maintaining the system in an operative position relative to an end of a rebar; and a plate disposed in the bore having a flange spaced from the second surface of the cover base plate to define an interior space and having a base with an engagement surface abuttable against the rebar end and a plate wall with a plate wall surface, the plate wall attached between the base and the flange with the plate wall surface generally transverse to the engagement surface to resist movement of the rebar end relative to the base with the rebar end abutting the base surface, one of the plate and the collar being deformable to resist movement of the rebar end through the interior space and the cover.

2. The safety system according to claim 1, wherein the plate has a plate edge which abuts the inner surface of the collar wall, and the plate and the collar wall are moveable relative to each other such that the plate edge deforms the collar wall as the plate and the collar wall move relative to each other to dissipate the energy generated by a force applied to the cover with a rebar end abutting the engagement surface of the plate.

3. The safety system according to claim 2, further comprising:

a spacer disposed in the interior space on the plate; and a second plate disposed in the interior space on the spacer.

4. A safety system for use with a concrete reinforcing bar or rebar comprising:

a cover for receiving a force thereon;

a support assembly attached to the cover and attachable to a rebar to hold the system in an operative position relative to an end of a rebar; and means disposed between the cover and the support assembly for dissipating the energy generated by a force applied to the cover to resist penetration of the cover with the support assembly attached to a rebar, comprising a plate having a flange spaced from the cover to define an interior space and having a base with an engagement surface abuttable against the rebar end and a plate wall with a plate wall surface, the plate wall attached between the base and the flange with the plate wall surface generally transverse to the engagement surface to resist movement of the rebar end relative relative to the base with the rebar end abutting the base surface.

5. The safety system according to claim 4, wherein:

the cover comprises a cover base plate with a first surface for receiving a force thereon and a second surface;

the support assembly comprises a cap with a surface spaced from the second surface of the cover to define a space therebetween; and the means for dissipating the energy generated by a force applied to the cover comprises a first dissipator plate disposed in the space on the cap surface, a first spacer disposed in the space on the first dissipator plate, and a second dissipator plate disposed in the space on the first spacer.

6. The safety system according to claim 5, further comprising a second spacer disposed in the space on the second dissipator plate, and a third dissipator plate disposed in the space on the second spacer.

7. The safety system according to claim 6, wherein the cover base plate comprises a plastic plate and the first and second dissipator plates comprise steel plates.

8. The safety system according to claim 4, wherein the means for dissipating the energy generated by a force applied to the cover comprises:

a collar attached to the cover and having a wall with an inner surface which defines a frusto-conical bore with an apex at a first end and a base at a second end; and a plate abuttable against an end of a rebar with the system in the operative position relative to the rebar and disposed at the base of the frusto-conical bore with an edge of the plate abutting the inner surface of the collar wall, the plate being moveable within the frusto-conical bore so as to cooperate with the collar wall such that one of the plate and the collar wall deforms as the plate and the collar wall move relative to each other to dissipate the energy generated when a force is applied to the cover and the support assembly is attached to a rebar.

9. The safety system according to claim 8, wherein the collar wall comprises a plastic wall, and the plate comprises a steel plate.

10. A safety system for use with a concrete reinforcing bar or rebar comprising:

a cover for receiving a force thereon;

a support assembly attached to the cover and attachable to a rebar to hold the system in an operative position relative to an end of a rebar; and a barrier assembly disposed between the cover and the support assembly having a barrier base plate with an engagement surface abuttable against an end of a rebar with the system in the operative position relative to a rebar end to resist penetration of the cover by the rebar and a barrier wall attached to the barrier base plate having a surface generally transverse to the engagement surface abuttable against an end of a rebar with the system in the operative position to restrict the movement of a rebar end relative to the barrier base plate.

11. The safety system according to claim 10, wherein the surface of the first barrier wall defines a receptacle for receiving an end of a rebar therein.

12. The safety system according to claim 10, wherein the support assembly comprises a support assembly collar having a support assembly collar wall with an inner surface which defines a bore to receive an end of a rebar therein, the bore being in communication with the receptacle so that a rebar end may be disposed through the bore and received in the receptacle.

13. The safety system according to claim 12, wherein the barrier wall of the barrier assembly depends into the bore of the support assembly collar.

14. The safety system according to claim 12, wherein the support assembly comprises fins attached to the collar wall and abuttable against a rebar to maintain the system in the operative position on the rebar.

15. The safety system according to claim 10, wherein the cover has a cover base plate having a first surface for receiving a force thereon and a plurality of ribs overlaid on the first surface of the cover base plate to reinforce the cover base plate.

16. The safety system according to claim 15, wherein the plurality of ribs comprise a first rib overlaid on the first surface of the cover base plate along a first axis and a second rib overlaid on the first surface of the cover first plate along a second axis transverse to the first axis.

17. The safety system according to claim 16, wherein the first and second axes are orthogonal to each other.

18. The safety assembly according to claim 10, wherein the cover comprises a cover base plate with a surface, and further comprising a first collar attached to the surface of the cover base plate and having a wall with an inner surface which with the surface of the cover base plate defines a first interior space with an open end, the barrier assembly being disposed within the first interior space and a first end of the support assembly disposed in the open end and attached to the first collar.

19. The safety system according to claim 18, wherein the first collar has a shoulder and the barrier base plate has an edge which abuts the shoulder and cooperates with the shoulder to dissipate energy generated when a force is applied to the cover and the support assembly is attached to a rebar.

20. The safety assembly according to claim 18, wherein the first collar has a rim at the open end of the first interior space, and the support assembly includes a cap having an edge, the rim deformed to abut the edge with the first end of the support assembly disposed in the first interior space to attach the support assembly to the cover.

21. The safety system according to claim 18, further comprising a second collar attached to the surface of the cover base plate, the second collar having a wall with an inner surface which with the surface of the cover base plate defines a second interior space in which barrier base plate and barrier wall are received with the barrier assembly disposed in the first interior space.

22. The safety system according to claim 10, the cover comprising a cover base plate with a surface, the safety system further comprising a first collar attached to the surface of the cover base plate and having a wall with an inner surface that defines with the surface of the cover base plate an interior space with an open end, the collar having a stop disposed within the interior space and the support assembly having a cap with a seat defined therein in which the stop is disposed with the cap disposed the interior space so that the support assembly is rotatably fixed relative to the cover.

* * * * *